US005774840A

United States Patent [19]

Taumi et al.

[11] Patent Number: 5,774,840

[45] Date of Patent: Jun. 30, 1998

[54] SPEECH CODER USING A NON-UNIFORM PULSE TYPE SPARSE EXCITATION CODEBOOK

[75] Inventors: Shin-ichi Taumi; Masahiro Serizawa, both of Tokyo, Japan

[73] Assignee: NEC Corporation, Tokyo, Japan

[21] Appl. No.: 512,635

[22] Filed: Aug. 8, 1995

[30] Foreign Application Priority Data

Aug. 11, 1994 [JP] Japan ..... 6-189612

[51] Int. Cl.[6] ..... G10L 9/00

[52] U.S. Cl. ..... 704/223; 704/230

[58] Field of Search ..... 395/2.32, 2.28, 395/2.31, 2.29, 2.27, 2.39; 704/223, 219, 222, 220, 218, 230, 217, 216

[56] References Cited

U.S. PATENT DOCUMENTS

| | | | |
|---|---|---|---|
| 4,868,867 | 9/1989 | Davidson et al. | 395/2.32 |
| 5,396,576 | 3/1995 | Miki | 395/2.31 |
| 5,485,581 | 1/1996 | Miyano et al. | 395/2.32 |
| 5,487,128 | 1/1996 | Ozawa | 395/2.31 |
| 5,598,504 | 1/1997 | Miyano | 395/2.31 |

FOREIGN PATENT DOCUMENTS

| | | | |
|---|---|---|---|
| 64-13199 | 1/1989 | Japan | G10L 9/18 |
| 4-171500 | 6/1992 | Japan | G10L 9/18 |
| 4-363000 | 12/1992 | Japan | G10L 9/18 |
| 5-6199 | 1/1993 | Japan | G10L 9/14 |
| 6-222797 | 8/1994 | Japan | G10L 9/14 |

OTHER PUBLICATIONS

Sixth International Conference on Digital Processing of Signals in Communications, Leung et al., "A new class of analysis by syntheiss LPC coders: multipulse excited sunbed LPC", pp. 240–243, Sep. 1991.

1995 International Conference on Acoustics, Speech, and Signal Processing, Minjie et al., "Fast and Low Complexity LSF Quantization using Algebraic vector Quantizer", pp. 716–719, May 1995.

Schroeder, "Code–Excited Linear Prediction(CELP): High–Quality Speech At Very Low Bit Rates", *Proc. ICASSP,* pp. 937–940 (1985).

Kleijn et al., "Improved Speech Quality And Efficient Vector Quantization", *Proc. ICASSP,* pp. 155–158, (1988).

Linde et al., "An Algorithm For Vector Quantizer Design", *IEEE Transactions On Communications,* vol. COM–28, No. 1, pp. 84–95, (1980).

Nomura et al., "LSP Coding Using VQ–SVQ With Interpolation In 4.075 KBPS M–LCELP Speech Coder", *Proc. Mobile Multimedia Communications,* pp. B.2.5–1–B.2.5–4, (1993).

Taniguchi et al., "Improved CELP Speech Coding At 4 KBITS/S and Below", *Proc. ICSLP,* pp. 41–44, (1992).

*Primary Examiner*—Allen R. MacDonald
*Assistant Examiner*—Richemond Dorvil
*Attorney, Agent, or Firm*—Foley & Lardner

[57] ABSTRACT

An excitation codebook 351 includes a plurality of codevectors each generated with pulse positions and amplitudes obtained by training such as to reduce the distance between the codevector and training speech data. The excitation codebook 351 further includes a plurality of sparse codevectors each generated with the pulse number, pulse positions and amplitudes obtained by training such as to reduce the distance between the codevector and training speech data, the individual codevectors having different pulse numbers.

10 Claims, 6 Drawing Sheets

SPEECH CODER USING A NON-UNIFORM PULSE TYPE SPARSE EXCITATION CODEBOOK

BACKGROUND OF THE INVENTION

The present invention relates to a speech coder for coding a speech signal in high quality at low bit rate, particularly 4.8 kb/s and below.

For speech signal coding at 4.8 kb/s and below, CELP (code-excited LPC coding) is well known in the art, as disclosed in, for instance, M. Schroeder and B. Atal "Code-Excited Linear Prediction: High Quality Speech at Very Low Bit Rate", Proc. ICASSP, pp. 937–940, 1985, and also in Kleijn et al, "Improved Speech Quality and Efficient Vector Quantization in CELP", Proc. ICASSP, pp. 155–158, 1988 (hereinafter referred to as Literature 1). In this system, on the transmitting side spectrum parameters representing a spectral characteristic of the speech signal are extracted for each frame (of 20 ms, for instance) therefrom through LPC (linear prediction) analysis. The frame is divided into a plurality of sub-frames (of 5 ms, for instance), and adaptive codebook parameters (i.e., a delay parameter corresponding to the pitch cycle and a gain parameter) are extracted for each sub-frame on the basis of past excitation signal. Then, the adaptive codebook pitch prediction of the sub-frame speech signal is used to obtain a residual signal. With respect to this residual signal an optimum excitation codevector is selected from an excitation codebook consisting of predetermined kinds of noise signals (i.e., vector quantization codebook). In this way, an optimum gain is calculated for quantizing the excitation signal. The excitation codevector is selected in such a manner as to minimize an error power between the signal synthesized from the selected noise signal and the above residual signal. The index representing the kind of the selected codevector and the gain are transmitted in combination with the spectrum parameters and adaptive codebook parameters by a multiplexer. The receiving side is not described.

In a prior art method for reducing the data storage amount and operation amount in CELP coding systems, a sparse excitation codebook is utilized. The prior art sparse excitation codebook, as shown in FIG. 5, has a features that for all of its codevectors the number of non-zero elements is fixed (i.e., nine, for instance). The prior art sparse codebook generation is taught in, for instance, Gercho et al, Japanese Patent Laid-Open Publication No. 13199/1989 (hereinafter referred to as Literature 2).

In the prior art sparse excitation codebook shown in Literature 2, the following codebook designs are executed. (1) In one method, some of the elements of each codevector generated by using white noise or the like, are replaced successively from smaller amplitude elements with zero. (2) In another method, training speech data is used for clustering and centroid calculation using a well-known LBG process, and centroid vectors obtained through the centroid calculation are made sparse in a process like that in the method (1).

A flow chart of the prior art sparse excitation codebook generation is shown in FIG. 6. Referring to FIG. 6, in a step 3010 a desired initial excitation signal (for instance a random number signal) is given. In a subsequent step 3020, the excitation codebook is trained a desired number of times using the well-known LBG process. Then in a step 3030, the finally trained excitation codebook in the LBG process training in the step 3020 is taken out. Then in a step 3040, each codevector in the finally trained excitation codebook taken out in the step 3030 is center clipped using a certain threshold value. For the details of the LBG process, see, for instance, Y. Linde, A. Buzo, R. M. Gray et al, "An Algorithm for Vector Quantizer Design", IEEE Trans. Commun., Vol. COM-28, pp. 84–95, January 1980.

In the above prior art speech coding system using the sparse excitation codebook, as shown in FIG. 6, in the step 3040 some of the centroid vector elements obtained by the centroid calculation are replaced from those of smaller amplitudes with zero. This step of shaping is liable to increase distortion. That is, there is a problem that an optimum codevector for training speech data can not be generated.

Further, in the usual excitation codevector there are some elements of very small amplitudes, as shown in FIG. 7. Large amplitude elements have great contribution to the reproduced speech, but small amplitude elements have less contribution. In the above prior art system, the number of non-zero elements are the same in all the codevectors. In practice, elements having less contribution (i.e., unnecessary elements) to the reproduced speech, have been adjusted with their amplitudes replaced to values near zero. Since in the prior art system described above unnecessary elements are present, the storage amount of the codebook and operation amount are unnecessarily increased.

SUMMARY OF THE INVENTION

An object of the present invention is to solve the above problems and provide a speech coder capable of generating optimum codevectors and reducing the storage amount and operation amount.

According to one aspect of the present invention, there is provided a speech coder for coding an excitation signal obtained by removing spectrum information from a speech signal by referring to an excitation codebook comprising a plurality of codevectors each having time-positions and amplitudes of non-zero elements, by selecting the most similar codevector to the excitation signal and transmitting an index of the selected codevector, wherein the number of non-zero elements of said codevector is determined based on a predetermined speech quality of reproduced speech or a predetermined calculation amount of the coding which is also adaptable to the following.

According to another aspect of the present invention, there is provided a speech decoder for coding an excitation signal obtained by removing spectrum information from a speech signal by referring to an excitation codebook comprising a plurality of codevectors each having time-positions and amplitudes of non-zero elements, by selecting the most similar codevector to the excitation signal and transmitting an index of the selected codevector, wherein said time-positions and amplitudes of non-zero elements are determined so as to reduce a distance between a speech vector obtained based on the selected codevector and a speech vector having the same length as the codevector obtained by cutting out a previously predetermined training speech signal.

According to other aspect of the present invention, there is provided a speech decoder for coding an excitation signal obtained by removing spectrum information from a speech signal by referring to an excitation codebook comprising a plurality of codevectors each having time-positions and amplitudes of non-zero elements, by selecting the most similar codevector to the excitation signal and transmitting an index of the selected codevector, wherein said time-positions of non-zero elements are determined so as to reduce a distance between a speech vector obtained based on the selected codevector and a speech vector having the same length as the codevector obtained by cutting out a previously predetermined training speech signal and then amplitudes of the non-zero elements are determined.

According to still other aspect of the present invention, there is provided a speech decoder for coding an excitation signal obtained by removing spectrum information from a speech signal by referring to an excitation codebook comprising a plurality of codevectors each having time-positions and amplitudes of non-zero elements, by selecting the most similar codevector to the excitation signal and transmitting an index of the selected codevector, wherein said time-positions and amplitudes of non-zero elements are determined so as to reduce a distance between a speech vector obtained based on the selected codevector and a speech vector having the same length as the codevector obtained by cutting out a previously predetermined training speech signal, and at least two of the codevectors have different numbers of non-zero elements.

According to a still further aspect of the present invention, there is provided a speech decoder for coding an excitation signal obtained by removing spectrum information from a speech signal by referring to an excitation codebook comprising a plurality of codevectors each having time-positions and amplitudes of non-zero elements, by selecting the most similar codevector to the excitation signal and transmitting an index of the selected codevector, wherein said time-positions of non-zero elements are determined so as to reduce a distance between a speech vector obtained based on the selected codevector and a speech vector having the same length as the codevector obtained by cutting out a previously predetermined training speech signal and then amplitudes of the non-zero elements are determined, and at least two of the codevectors have different numbers of non-zero elements.

Other objects and features of the present invention will be clarified from the following description with reference to attached drawings.

DETAILED DESCRIPTION OF THE PREFERRED EMBODIMENTS

Figure 1:
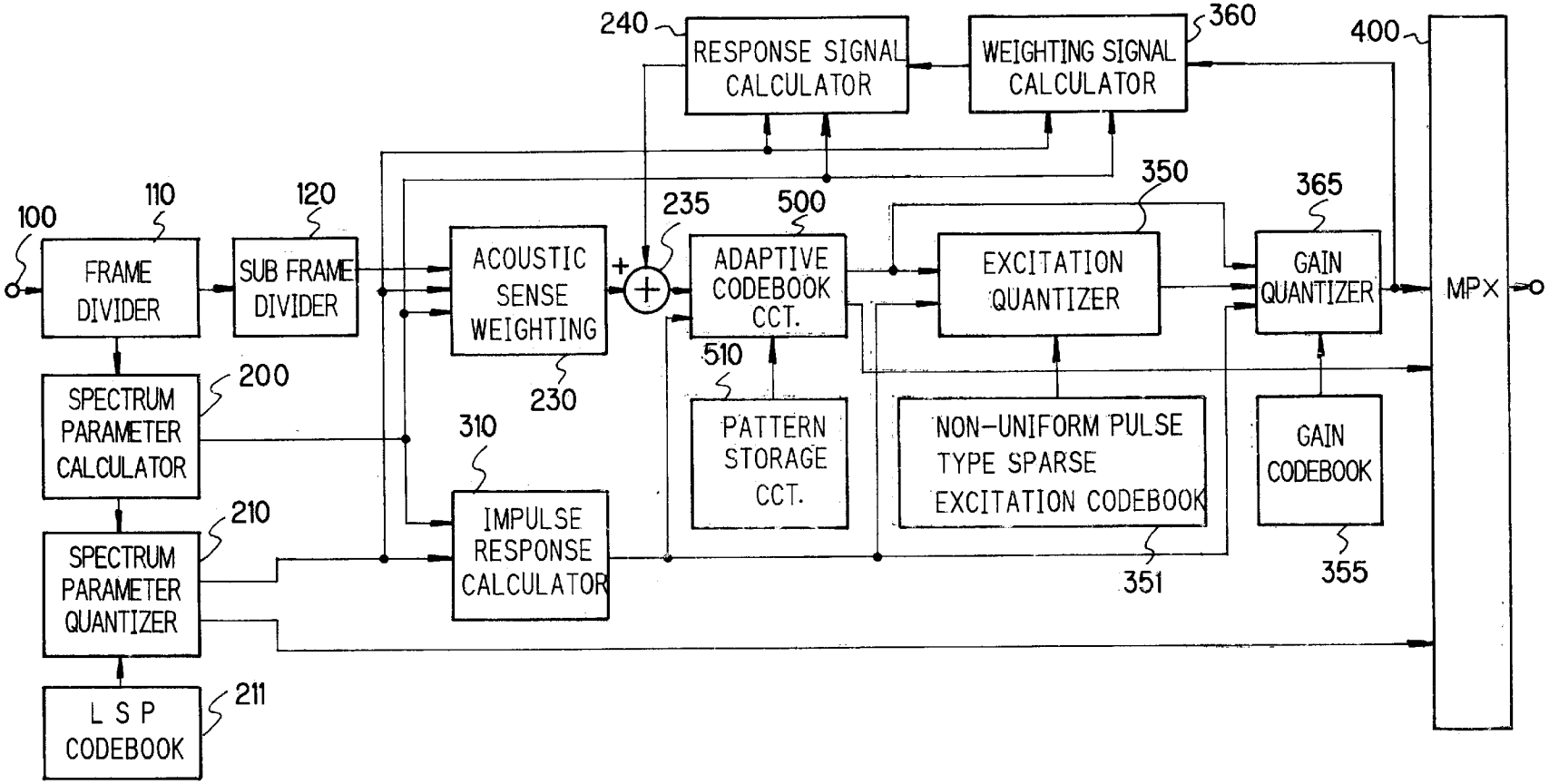
FIG. 1 shows an embodiment of a speech coder with a non-uniform pulse number type sparse excitation codebook according to the present invention.

An embodiment of a speech coder with non-uniform pulse number type sparse excitation codebook according to the present invention, is shown in the block diagram of FIG. 1. An input speech signal divider 110 is connected to an acoustical sense weighter 230 through a spectrum parameter calculator 200 and a frame divider 120. The spectrum parameter calculator 200 is connected to a spectrum parameter quantizer 210, the acoustical sense weighter 230, a response signal calculator 240 and a weighting signal calculator 360. An LSP codebook 211 is connected to the spectrum parameter quantizer 210. The spectrum parameter quantizer 210 is connected to the acoustical sense weighter 230, the response signal calculator 240, the weighting signal calculator 360, an impulse response calculator 310, and a multiplexer 400.

The impulse response calculator 310 is connected to an adaptive codebook circuit 500, an excitation quantizer 350 and a gain quantizer 365. The acoustical sense weighter 230 and response signal calculator 240 are connected via a subtractor 235 to the adaptive codebook circuit 500. The adaptive codebook 500 is connected to the excitation quantizer 350, the gain quantizer 365 and multiplexer 400. The excitation quantizer 350 is connected to the gain quantizer 365. The gain quantizer 365 is connected to the weighting signal calculator 360 and multiplexer 400. A pattern accumulator 510 is connected to the adaptive codebook circuit 500. A non-uniform sparse type excitation codebook 351 is connected to the excitation quantizer 350. A gain codebook 355 is connected to a gain quantizer 365.

The operation of the embodiment will now be described. Referring to FIG. 1, speech signals from an input terminal 100 are divided by the input speech signal divider 110 into frames (of 40 ms, for instance). The sub-frame divider 120 divides the frame speech signal into sub-frames (of 8 ms, for instance) shorter than the frame.

The spectrum parameter calculator 200 calculates spectrum parameters of a predetermined order (for instance, P=10-th order) by cutting out the speech through a window (of 24 ms, for instance) longer than the sub-frame length to at least one sub-frame speech signal. The spectrum parameter is changed greatly with time particularly in a transition portion between a consonant and a vowel. This means that the analysis is preferably made at as short interval as possible. With reducing interval of analysis, however, the amount of operations necessary for the analysis is increased. Here, an example is taken in which the spectrum parameter calculation is made for L (L>1) sub-frames (for instance L=3 with the 1st, 2nd and 3rd sub-frames) in the frame. For the sub-frames which are not analyzed (i.e., the 2nd and 4th sub-frames here), the spectrum parameters used are obtained through linear interpolation, on LSP to be described later, between the spectrum parameters of the 1st and 3rd sub-frames and between those of the 3rd and 5th sub-frames. The spectrum parameter may be calculated through well-known LPC analysis, Burg analysis, etc. Here, Burg analysis is employed. The Burg analysis is described in detail in Nakamizo, "Signal Analysis and System Identification", Corona Co., Ltd., 1988, pp. 82–87. The spectrum parameter calculator 200 converts linear prediction coefficients $\alpha_i$ (i=1, . . . , 10) calculated by the Burg analysis into LSP parameters suited for quantization or interpolation. For the conversion of the linear prediction coefficient into the LSP parameter, reference may be made to Sugamura et al, "Compression of Speech Information by Linear Spectrum Pair (LSP) Speech Analysis/Synthesis System", Proc. of the Society of Electronic Communication Engineers of Japan, J64-A, 1981, pp. 599–606. Specifically, the linear prediction coefficients of the 1st, 3rd and 5th sub-frames obtained by the Burg analysis are converted into LPS parameters, and the LSP parameters of the 2nd and 4th sub-frames are obtained through the linear interpolation and inversely converted into linear prediction coefficients. Thus obtained linear prediction coefficients $\alpha_{ij}$ (i=1 , . . . , 10, j=1, . . . , 5) of the 1st to 5th sub-frames are supplied to the acoustical sense weighter 230, while the LSP parameters of the 1st to 5th sub-frames are supplied to the spectrum parameter quantizer 210.

The spectrum parameter quantizer 210 efficiently quantizes LSP parameters of predetermined sub-frames. It is hereinafter assumed that the vector quantization is employed and the quantization of the 5th sub-frame LSP parameter is taken as example. The vector quantization of LSP parameters may be made by using well-known processes. Specific examples of process are described in, for instance, the specifications of Japanese Patent Application No. 171500/1992, 363000/1992 and 6199/1993 (hereinafter referred to as Literatures 3) as well as T. Nomura et al, "LSP Coding Using VQ-SVQ with Interpolation in 4.075 kb/s M-LCELP Speech Coder", Proc. Mobile Multimedia Communications, 1993, pp. B.2.5 (hereinafter referred to as Literature 4). The spectrum parameter quantizer 210 restores the 1st to 4th sub-frame LSP parameters from the 5th sub-frame quantized LSP parameter. Here, the 1st to 4th sub-frame LSP parameters are restored through linear interpolation of the 5th sub-frame quantized LSP parameter of the prevailing frame and the 5th sub-frame quantized LSP parameter of the immediately preceding frame. In this case, it is possible to restore the 1st to 4th sub-frame LSP parameters through the linear interpolation after selecting one codevector which can minimize the power difference between LSP parameters before and after the quantization. Further in order to improve the characteristic it is possible to select a plurality of candidates for the codevector minimizing the power difference noted above, evaluate the accumulated distortion of each candidate and select a set of candidate and interpolation LSP parameters for minimizing the accumulated distortion. For details, see, the specification of Japanese Patent Lid-Open No. 222797/1994.

The 1st to 4th sub-frame LSP parameters and 5th sub-frame quantized LSP parameters that have been restored are converted for each sub-frame into linear prediction coefficients $\alpha'_{ij}$ (i=1, . . . , 10, j=1, . . . , 5) to be supplied to the impulse response calculator 310. Further, an index representing the 5th sub-frame quantized LSP codevector is supplied to the multiplexer 400. In lieu of the above linear interpolation, it is possible to prepare LSP interpolation patterns for a predetermined number of bits (for instance, two bits), restore 1st to 4th sub-frame LSP parameters for each of these patterns and select a set of codevector and interpolation pattern for minimizing the accumulated distortion. In this case, the transmitted information is increased by an amount corresponding to the interpolation pattern bit number, but it is possible to express the LSP parameter changes in the frame with time. The interpolation pattern may be produced in advance through training based on the LSP data. Alternatively, predetermined patterns may be stored. As the predetermined patterns it may be possible to use those described in, for instance, T. Taniguchi et al, "Improved CELP Speech Coding at 4 kb/s and Below", Proc. ICSLP, 1992, pp. 41–44. For further characteristic improvement, an error signal between true and interpolated LSP values may be obtained for a predetermined sub-frame after the interpolation pattern selection, and the error signal may further be represented with an error codebook. For details, reference may be had to Literatures 3, for instance.

The acoustical sense weighter 230 receives for each sub-frame the linear prediction coefficient $\alpha_{ij}$ (i=1, . . . , 10, j=1, . . . , 5) prior to the quantization from the spectrum parameter calculator 200 and effects acoustical sense weighting of the sub-frame speech signal according to the technique described in Literature 4, thus outputting an acoustical sense weighted signal.

The response signal calculator 240 receives for each sub-frame the linear prediction coefficient $\alpha_{ij}$ from the spectrum parameter calculator 200 and also receives for each sub-frame the linear prediction coefficient $\alpha'_{ij}$ restored through the quantization and interpolation from the spectrum parameter quantizer 210. The response signal calculator 240 calculates a response signal with respect to the input signal d(n)=0 based on the value stored in the filter memory, the calculated response signal being supplied to the subtractor 235. The response signal $x_z(N)$ is expressed by Equation (1).

$$x_z(n) = d(n) - \sum_{i=1} \alpha_i d(n-i) + \sum_{i=1} \alpha_i \gamma^i y(n-i) + \sum_{i=1} \alpha_i' \gamma^i x_z(n-i) \tag{1}$$

Where γ is a weighting coefficient for controlling the amount of acoustical sense weighting and has the same value as in Equation (3) below and $$y(n) = d(n) - \sum_{i=1}^{10} \alpha_i d(n-i) + \sum_{i=1}^{10} \alpha_i \gamma^i y(n-i)$$

The subtractor 235 subtracts the response signal from the acoustical sense weighted signal for one sub-frame as shown in Equation (2), and outputs $x_w'(n)$ to the adaptive codebook circuit 500.

$$x_w'(n) = x_w(n) - x_z(n) \tag{2}$$

The impulse response calculator 310 calculates, for a predetermined number L of points, the impulse response hw(n) of weighting filter with z conversion thereof given by Equation (3) and supplies hw(n) to the adaptive codebook circuit 500 and excitation quantizer 350.

$$Hw(z) = \frac{1 - \sum_{i=1}^{10} \alpha_i z^{-i}}{1 - \sum_{i=1}^{10} \alpha_i \gamma^i z^{-i}} \quad \frac{1}{1 - \sum_{i=1}^{10} \alpha_i' \gamma^i z^{-i}} \tag{3}$$

The adaptive codebook circuit 500 derives the pitch parameter. For details, Literature 1 may be referred to. The circuit 500 further makes the pitch prediction with adaptive codebook as shown in Equation (4) to output the adaptive codebook prediction error signal z(n).

$$z(n) = x_w'(n) - b(n) \tag{4}$$

where b(n) is an adaptive codebook pitch prediction signal given as:

$$b(n) = \beta v(n-T) h_w(n) \tag{5}$$

where β and T are the gain and delay of the adaptive codebook. The adaptive codebook is represented as v(n).

Figure 2:
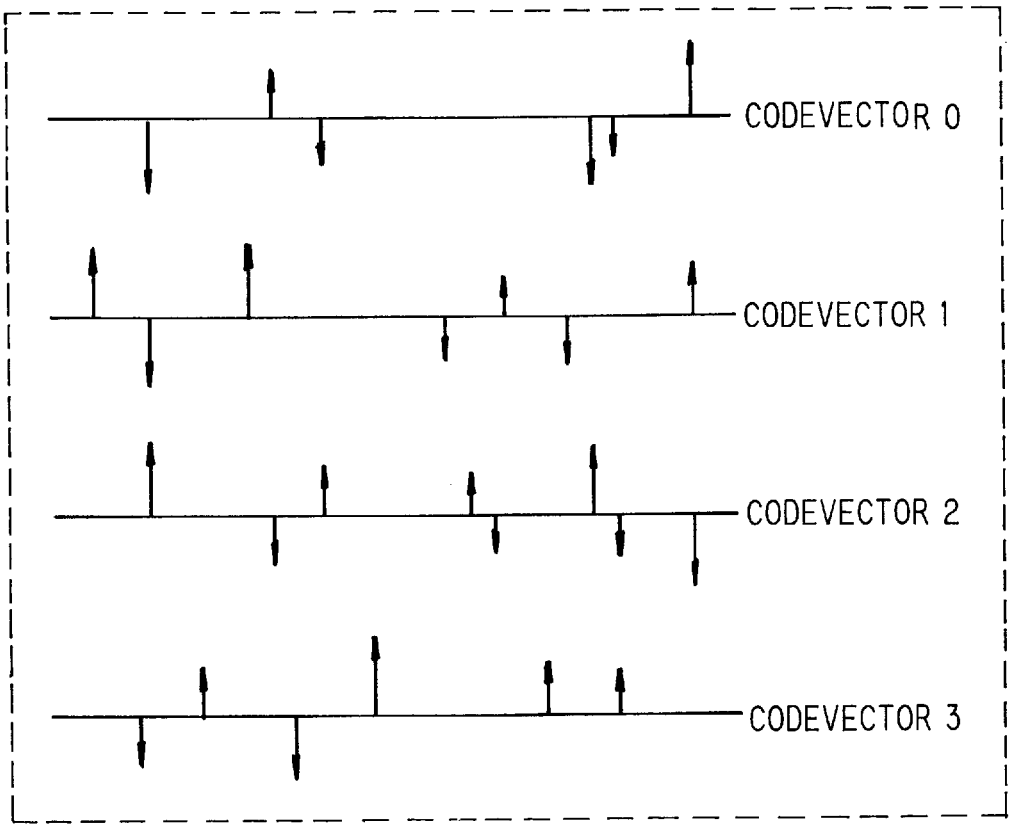
FIG. 2 shows a non-uniform pulse type sparse excitation codebook 351 in FIG. 1.

The non-uniform pulse type sparse excitation codebook 351 is as shown in FIG. 2, a sparse codebook having different numbers of non-zero components of the individual vectors.

Figure 3:
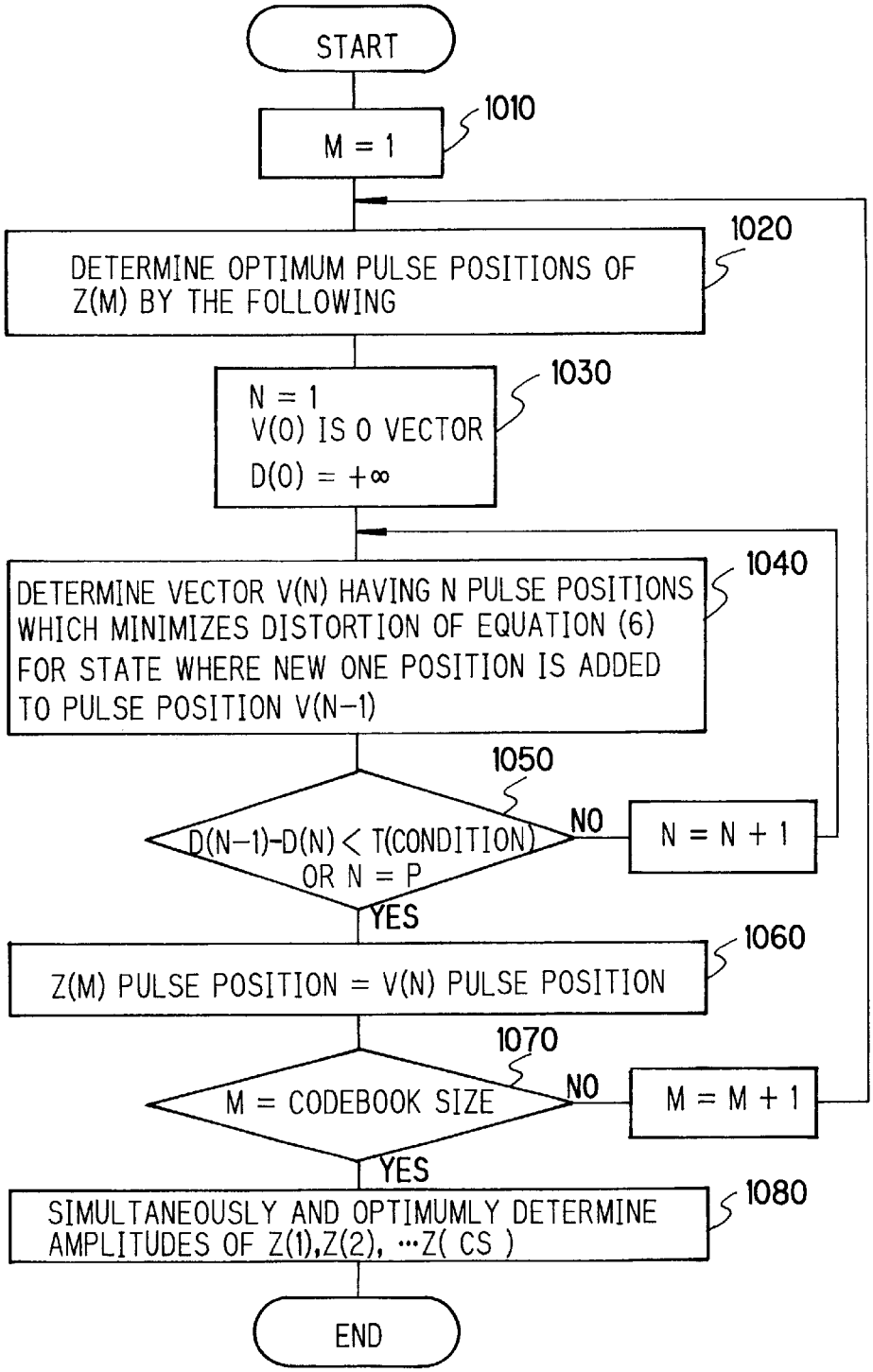
FIG. 3 is a flow chart for explaining the production of a non-uniform pulse number type sparse excitation codebook, in which the non-zero elements in the individual codevectors are no greater than P in number.

FIG. 3 is a flow chart for explaining the production of a non-uniform pulse number type sparse excitation codebook, in which the non-zero elements in the individual codevectors are no greater than P in number. The codebooks to be produced are expressed as Z(1), Z(2), . . . , Z(CS) wherein CS is a codebook size. Distortion distance used for the production is shown in Equation (6). In Equation (6), S is training data cluster, Z is codevector of S, $w_t$ is training data contained in S, $g_t$ is optimum gain, and $H_{wt}$ is the impulse response of weighting filter. Equation (7) gives the summation of all the cluster training data and codevectors thereof in Equation (6).

$$D = \sum_{w \in s} |\omega_t - g_t H_{wt} z)|^2 \quad (6)$$

$$D = \sum_{i=1}^{CS} \sum_{w \in s(i)} |\omega_t - g_t H_{wt} z(i))|^2 \quad (7)$$

Equations (6) and (7) are only an example, and various other Equations are conceivable.

Referring to FIG. 3, in a step 1010 the determination of the optimum pulse position of the 1st codevector Z(1) is declared. In a step 1020, the optimum pulse position of the Mth codevector Z(M) is declared. In a step 1030, pulse number N, dummy codevector V and distortion thereof and the training data are initialized. In a step 1040, a dummy codevector V(N) having N optimum pulse positions is produced. Also, distortion D(N) of V(N) and the training data is obtained. In a step 1050, a decision is made as to whether the pulse number of V(N) last is to be increased. Here, the condition A in the step 1050 is adapted for the training. In a step 1060, the optimum pulse position of Z(M) is determined as that of V(N). In a step 1070, the optimum pulse positions of all of Z(1), Z(2), . . . , Z (CS) are determined. In a step 1080, the pulse amplitudes of all of Z(1), Z(2), . . . , Z (CS) are obtained as optimum values of the same order by using Equation (7). In the flow of FIG. 3, it is possible to add condition A in all studies.

Figure 4:
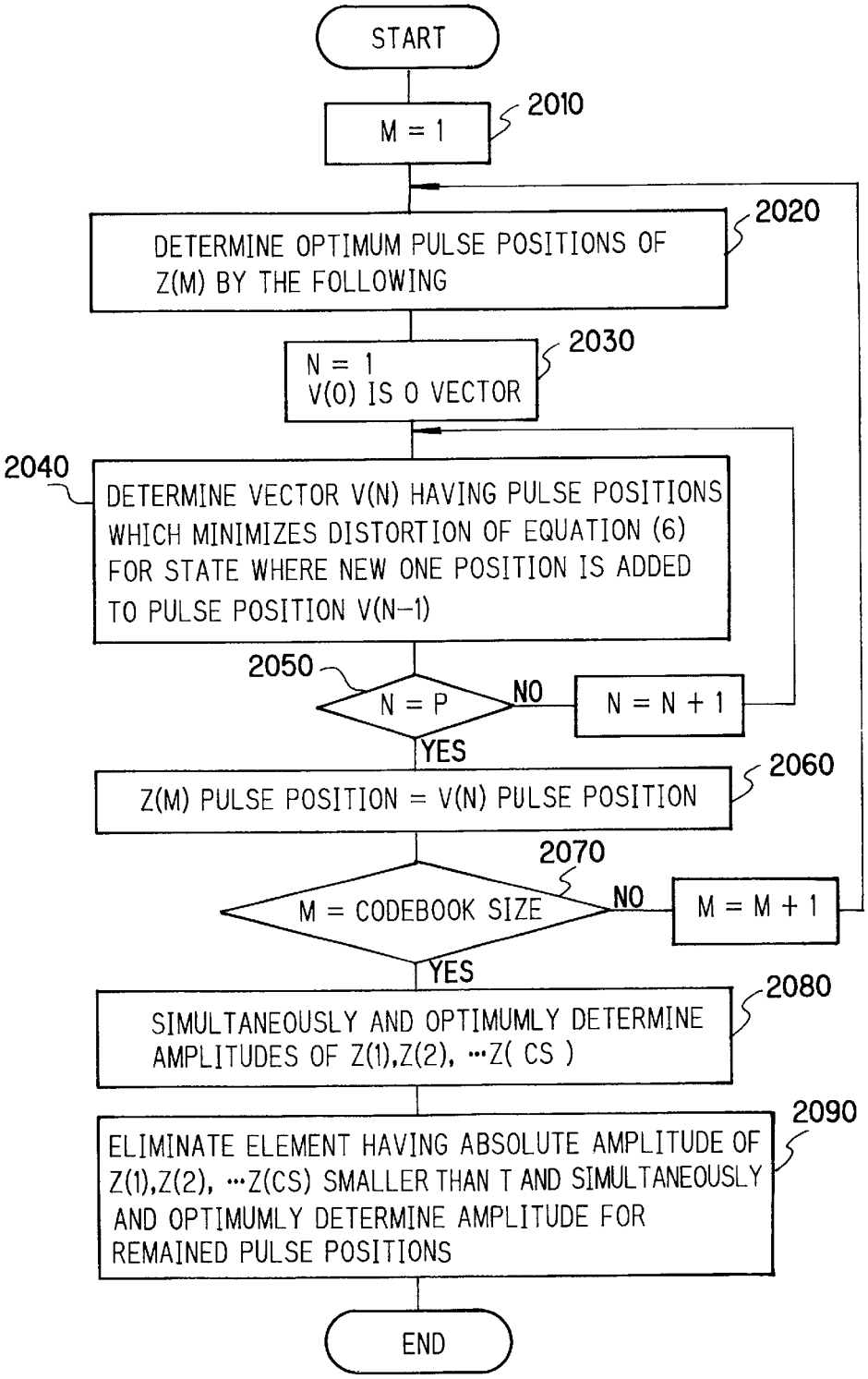
FIG. 4 is a flow chart for explaining a different example of operation.
Figure 5:
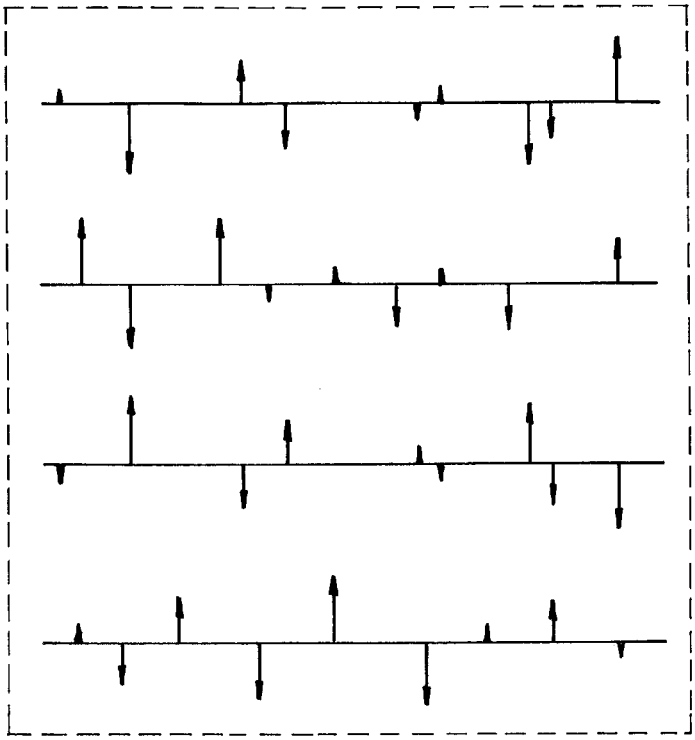
FIG. 5 PRIOR ART
FIG. 5 shows the prior art sparse excitation codebook.
Figure 6:
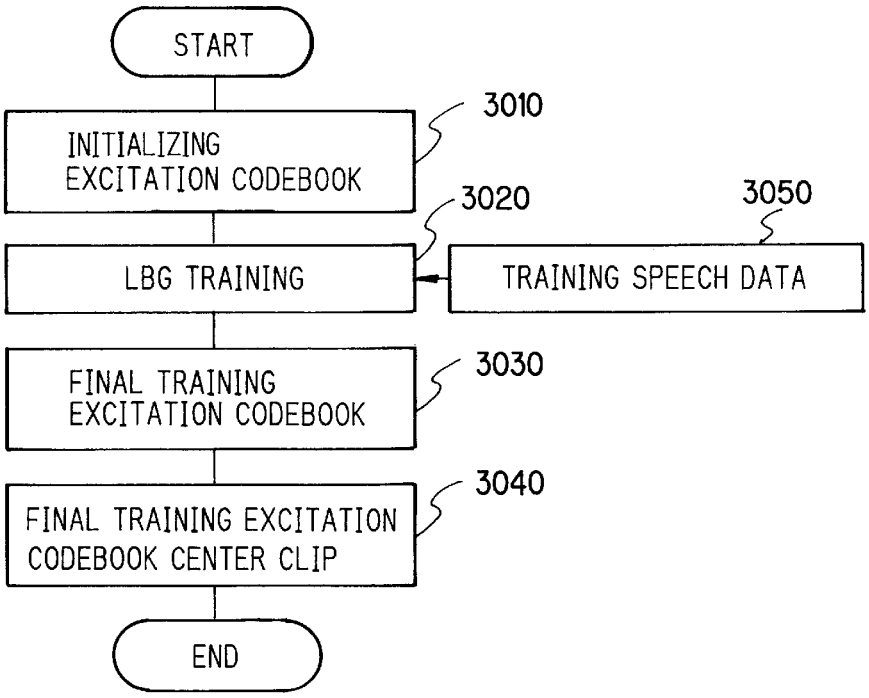
FIG. 6 PRIOR ART
FIG. 6 shows the prior art speech coder using the sparse excitation codebook.
Figure 7:
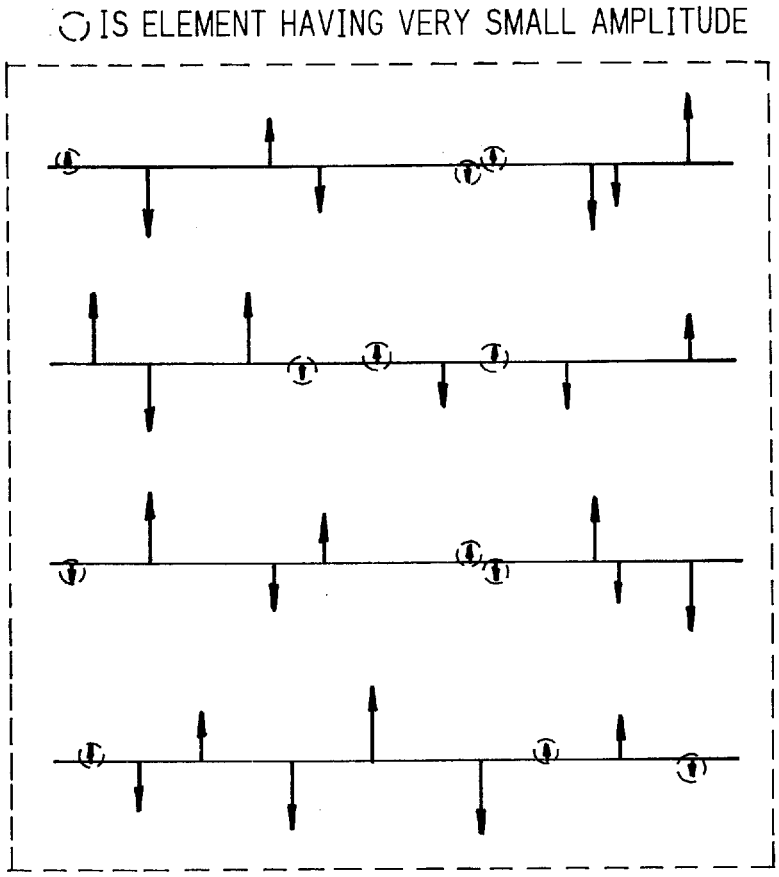
FIG. 7 PRIOR ART
FIG. 7 shows a usual excitation codevector having some elements of very small amplitudes.

FIG. 4 is a flow chart for explaining a different example of operation. Here, in a step 2010 the determination of the optimum pulse position of the 1st codevector Z(1) is declared. In a step 2020, the determination of the optimum pulse position of the Mth codevector Z(M) is declared. In a step 2030, pulse number N and dummy codevector V are initialized. In a step 2040, dummy codevector V(N) having N optimum pulse positions is produced. In a step 2050, a decision is made as to whether the pulse number of V(N) is to be increased. In a step 2070, the optimum pulse positions of all of Z(1), Z(2), . . . , Z (CS) are determined. In a step 2080, the pulse amplitudes of all of Z(1), Z(2), . . . , z (CS) are obtained as optimum values of the same order by using Equation (7). Only at the time of the last training, a step 2090 is executed to produce a non-uniform pulse number codebook. In the flow of FIG. 4, it is possible to add the step 2090 in all the studies.

Referring back to FIG. 1, the excitation quantizer 350 selects the best excitation codebook cj(n) for minimization of all or some of excitation codevectors stored in the excitation codebook 351 by using Equation (8) given below. At this time, one best codevector may be selected. Alternatively, two or more codevectors may be selected, and one codevector may be made when making gain quantization. Here, it is assumed that two or more codevectors are selected.

$$D_j = \Sigma_n (z(n) - \gamma_j C_j(n) h_w(n))^2 \quad (8)$$

When applying Equation (8) only to some codevectors, a plurality of excitation codevectors are preliminarily selected. Equation (8) may be applied to the preliminarily selected excitation codevectors as well. The gain quantizer 365 reads out the gain codevector from the gain codebook 355 and selects a set of the excitation codevector and the gain codevector for minimizing Equation (9) for the selected excitation codevector.

$$D_{j,k} = \Sigma_n (x_w(n) - \beta_k' v(n-T) h_w(n) - \gamma_k' c_j(n) h_w(n))_2 \quad (9)$$

where $\beta'_k$ and $\gamma'_k$ represent the kth codevector in a two-dimensional codebook stored in the gain codebook 355. Impulses representing the selected excitation codevector and gain codevector are supplied to the multiplexer 400.

The weighting signal calculator 360 receives the output parameters and indexes thereof from the spectrum parameter calculator 200, reads out codevectors in response to the index, and develops a driving excitation signal v(n) based on Equation (10).

$$v(n) = \beta_k' v(n-T) + \gamma_k' cj(n) \quad (10)$$

Then, by using the output parameters of the spectrum parameter calculator 200 and those of the spectrum parameter quantizer 210, a weighting signal sw(n) is calculated for each sub-frame based on Equation (11) and is supplied to the response signal calculator 240.

$$s_w(n) = v(n) - \sum_{i=1} \alpha_i v(n-i) + \sum_{i=1} \alpha_i \gamma^i P(n-i) + \sum_{i=1} \alpha_i' \gamma^i s_w(n-i) \quad (11)$$

As has been described in the foregoing, in the CELP speech coder according to the present invention, by varying the number of non-zero elements of each vector for obtaining the same characteristic, it is possible to remove small amplitude elements providing less contribution to restored speech and thus reduce the number of elements. It is thus possible to reduce codebook storage amount and operation amount, which is a very great advantage.

According to the present invention, for obtaining the same characteristic the small amplitude elements with less contribution to the reproduced speech can be removed by varying the number of non-zero elements in each vector. Thus, the number of elements can be reduced to reduce the codebook storage amount and operation amount.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

What is claimed is:

1. A speech coder for coding an excitation signal obtained by removing spectrum information from a speech signal, the speech coder comprising:

an excitation codebook which includes a plurality of codevectors, each codevector having time-positions and amplitudes of non-zero elements;

means for selecting a codevector most similar to the excitation signal and for transmitting an index of the selected codevector; and means for determining the number of non-zero elements of said codevector based on a predetermined speech quality of reproduced speech.

2. A speech coder for coding an excitation signal obtained by removing spectrum information from a speech signal, the speech coder comprising:

an excitation codebook which includes a plurality of codevectors, each codevector having time-positions and amplitudes of non-zero elements;

means for selecting a codevector most similar to the excitation signal and for transmitting an index of the selected codevector; and means for determining the number of non-zero elements of said codevector based on a predetermined calculation amount of coding.

3. A speech coder for coding an excitation signal obtained by removing spectrum information from a speech signal, the speech coder comprising:

an excitation codebook which includes a plurality of codevectors, each codevector having time-positions and amplitudes of non-zero elements;

means for selecting a codevector most similar to the excitation signal and for transmitting an index of the selected codevector; and means for determining said time-positions and amplitudes of non-zero elements so as to reduce a distance between a speech vector obtained based on the selected codevector and a speech vector having the same length as a codevector obtained by cutting out a previously predetermined training speech signal.

4. A speech coder for coding as set forth in claim 3, wherein the number of non-zero elements of said codevector is determined based on at least one of a predetermined speech quality of reproduced speech and a predetermined calculation amount of coding.

5. A speech coder for coding an excitation signal obtained by removing spectrum information from a speech signal, the speech coder comprising:

an excitation codebook which includes a plurality of codevectors, each codevector having time-positions and amplitudes of non-zero elements;

means for selecting a codevector most similar to the excitation signal and for transmitting an index of the selected codevector; and means for determining said time-positions of non-zero elements so as to reduce a distance between a speech vector obtained based on the selected codevector and a speech vector having the same length as a codevector obtained by cutting out a previously predetermined training speech signal and for then determining amplitudes of the non-zero elements.

6. A speech coder for coding as set forth in claim 5, wherein the number of non-zero elements of said codevector is determined based on at least one of a predetermined speech quality of reproduced speech and a predetermined calculation amount of coding.

7. A speech coder for coding an excitation signal obtained by removing spectrum information from a speech signal, the speech coder comprising:

an excitation codebook which includes a plurality of codevectors, each codevector having time-positions and amplitudes of non-zero elements;

means for selecting a codevector most similar to the excitation signal and for transmitting an index of the selected codevector; and means for determining said time-positions and amplitudes of non-zero elements so as to reduce a distance between a speech vector obtained based on the selected codevector and a speech vector having the same length as a codevector obtained by cutting out a previously predetermined training speech signal, wherein at least two of the codevectors have different numbers of non-zero elements.

8. A speech coder for coding as set forth in claim 7, wherein the number of non-zero elements of said codevector is determined based on at least one of predetermined speech quality of reproduced speech and a predetermined calculation amount of coding.

9. A speech coder for coding an excitation signal obtained by removing spectrum information from a speech signal, the speech coder comprising:

an excitation codebook which includes a plurality of codevectors, each codevector having time-positions and amplitudes of non-zero elements;

means for selecting a codevector most similar to the excitation signal and for transmitting an index of the selected codevector; and means for determining said time-positions of non-zero elements so as to reduce a distance between a speech vector obtained based on the selected codevector and a speech vector having the same length as a codevector obtained by cutting out a previously predetermined training speech signal and for then determining amplitudes of the non-zero elements, wherein at least two of the codevectors have different numbers of non-zero elements.

10. A speech coder for coding as set forth in claim 9, wherein the number of non-zero elements of said codevector is determined based on at least one of a predetermined speech quality of reproduced speech and a predetermined calculation amount of coding.

* * * * *